US006532991B1

(12) United States Patent
Wood et al.

(10) Patent No.: US 6,532,991 B1
(45) Date of Patent: Mar. 18, 2003

(54) AIR COMPRESSOR ASSEMBLY INCLUDING A HANDLE CAPABLE OF ATTAINING A PLURALITY OF POSITIONS

(75) Inventors: Mark W. Wood, Jackson, TN (US); Crandall B. Barbour, Jackson, TN (US); David W. Robenalt, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/801,408

(22) Filed: Mar. 8, 2001

Related U.S. Application Data

(60) Provisional application No. 60/187,723, filed on Mar. 8, 2000.

(51) Int. Cl.[7] ..... B60P 3/22; B65H 75/34

(52) U.S. Cl. ..... 137/899.4; 137/269; 137/271

(58) Field of Search ..... 137/899.4, 269, 137/271

(56) References Cited

U.S. PATENT DOCUMENTS

| | | | | |
|---|---|---|---|---|
| 2,122,656 | A | 7/1938 | Paget | 137/899.4 |
| 4,512,361 | A | 4/1985 | Tisbo et al. | 137/355.27 |
| 4,777,976 | A | 10/1988 | Johnston et al. | 137/355.27 |
| D447,149 | S | 8/2001 | Davis et al. | D15/9 |

*Primary Examiner*—A. Michael Chambers
(74) *Attorney, Agent, or Firm*—Suiter & Associates PC

(57) ABSTRACT

The present invention is directed to an air compressor assembly including a handle assembly capable of assuming a plurality of positions. In a first aspect of the present invention, an air compressor assembly includes an air reservoir suitable for storing compressed air, the reservoir having a first side portion and a second side portion. A handle assembly is disposed on the air reservoir, the handle assembly capable of attaining a first position and a second position, wherein the second position generally aligns the handle assembly at least partially along at least one of the first and second side portions.

32 Claims, 15 Drawing Sheets

AIR COMPRESSOR ASSEMBLY INCLUDING A HANDLE CAPABLE OF ATTAINING A PLURALITY OF POSITIONS

CROSS REFERENCE TO RELATED APPLICATION

The present invention claims benefit of 35 U.S.C. §119(e) of U.S. Application No. 60/187,723 filed Mar. 8, 2000. Said U.S. Patent Application No. 60/187,723 is herein incorporated by reference in its entirety.

FIELD OF THE INVENTION

The present invention generally relates to the field of air compressor assemblies, and particularly to an air compressor including a handle capable of assuming a plurality of positions.

BACKGROUND OF THE INVENTION

The supply of compressed air is one of the most important considerations in manufacturing operations. From residential construction to plant operations, compressed air is utilized to perform many necessary operations, such as powering air tools and sprayers. In portable applications, air compressor assemblies are typically transported with the use of a wheel assembly and a transport handle assembly used to guide the air compressor assembly when utilizing the wheel assembly. However, a typical transport handle assembly is not suited for lifting the air compressor, such as when the air compressor assembly is loaded into a truck, needs to be transported over stairs, lifted over uneven ground, and the like. Further, an air compressor assembly may weigh hundreds of pounds, thereby requiring a substantial force to be exerted to lift the air compressor assembly.

The failure of the typical transport handle assembly to supply an accommodating way of lifting the air compressor assembly often requires users, when trying to lift the air compressor assembly to wrap their arms around the air reservoir, grasp a wheel assembly, grip the motor assembly, and engage in other very difficult and unsure maneuvers. These maneuvers may cause damage to the air compressor assembly and even injury to the user due to the size and weight of a typical air compressor assembly.

Therefore, it would be desirable to provide an air compressor assembly including a handle capable of assuming a plurality of positions.

SUMMARY OF THE INVENTION

Accordingly, the present invention is directed to an air compressor assembly including a handle assembly capable of assuming multiple positions. In a first aspect of the present invention, an air compressor assembly includes an air reservoir suitable for storing compressed air, the reservoir having a first side portion and a second side portion. A handle assembly including a handle is disposed on the air reservoir, the handle assembly capable of attaining a first position and a second position, wherein the second position generally aligns the handle at least partially along at least one of the first and second side portions. It may also be desirable to have the first position include aligning the handle outward from an end portion of the air reservoir.

In a second aspect of the present invention, an air compressor assembly includes an air reservoir suitable for storing compressed air, the reservoir having a top edge. A handle assembly including a handle is disposed on the air reservoir. The handle assembly is capable of attaining a first position and a second position, wherein the first position arranges the handle generally above the top edge of the air reservoir and the second position arranges the handle generally below the top edge of the air reservoir.

In a third aspect of the present invention, an air compressor assembly includes an air reservoir suitable for storing compressed air having an end portion. A handle assembly including a handle is disposed on the air reservoir, the handle assembly capable of attaining a first position and a second position, wherein the first position arranges the handle generally outward from the end portion and the second position arranges the handle generally inward from the end portion.

In a fourth aspect of the present invention, an air compressor assembly includes an air reservoir suitable for storing compressed air and a wheel assembly disposed on the air reservoir, the wheel assembly suitable for transporting the air reservoir. A handle assembly including a handle is disposed on the air reservoir. The handle assembly is capable of attaining a first position and a second position, wherein the first position arranges the handle so as to be suitable for transporting the air compressor assembly utilizing the wheel assembly. The second position arranges the handle so as to be suitable for lifting the air compressor assembly.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring generally now to FIGS. 1 through 14, exemplary embodiments of the present invention are shown. Air compressor assemblies may include an air reservoir for the storage of compressed air. In portable applications, air compressor assemblies are typically transported with the use of a wheel assembly and a handle assembly used to guide the air compressor assembly when utilizing the wheel assembly. However, a typical handle assembly is not suited for lifting the air compressor, such as when the air compressor assembly is loaded into a truck, needs to be transported over stairs, lifted over uneven ground, and the like. Therefore, by supplying a handle capable of assuming multiple positions as a part of the air compressor assembly, the assembly may be more easily lifted.

Figure 1:
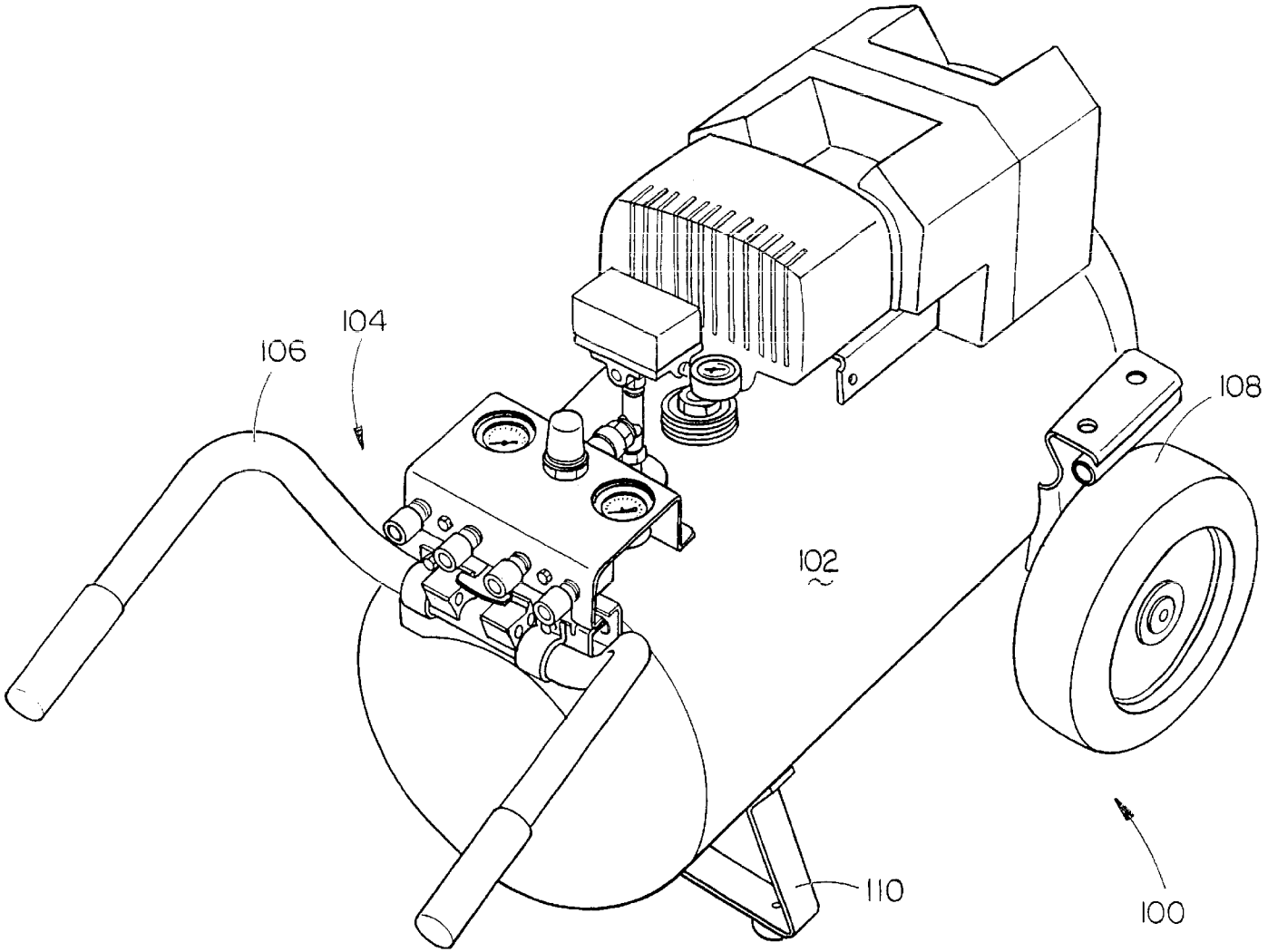
FIG. 1 is an isometric drawing of an exemplary embodiment of the present invention wherein an air compressor assembly includes a handle assembly including a handle capable of assuming a plurality of positions.

Referring now to FIG. 1, an exemplary embodiment of the present invention is shown wherein an air compressor assembly 100 includes a handle suitable for attaining a plurality of positions, thereby enabling the assembly 100 to be lifted in an easier manner. The air compressor assembly 100 generally includes an air reservoir 102 for the storage of compressed air. Typically, the supply of compressed air is accomplished through the use of a compressor and motor, which may be gasoline, electric, and the like. A handle assembly 104 including a handle 106 may be utilized to control the movement of the air compressor assembly 100 when utilizing the wheel assembly 108. In this way, the air compressor assembly 100 is capable of portable operation by tilting a base 110 of the air compressor assembly 100 from a surface thereby permitting the wheel assembly 108 to roll.

Figure 2:
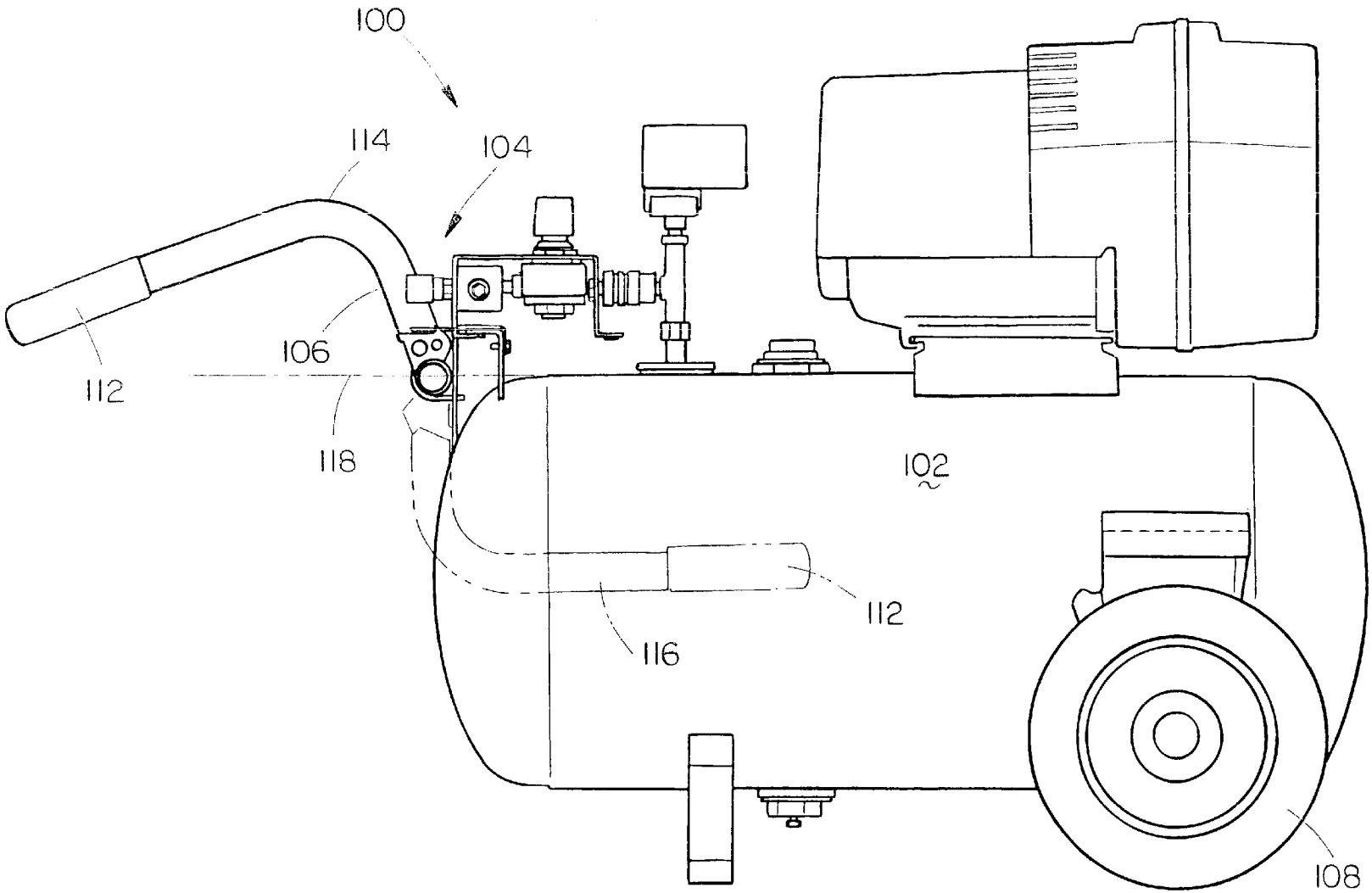
FIG. 2 is a side view of the exemplary embodiment as shown in FIG. 1, wherein a handle assembly suitable for attaining a plurality of positions is shown in a first position and a second position.

The air compressor assembly 100 includes a handle assembly 106 capable of assuming multiple positions, an example of which is shown in FIG. 2. The handle assembly 104, including a handle 106 with a grasping region 112 suitable for being manually grasped by a user, is capable of attaining both a first position 114 and a second position 116. The air reservoir 102 is oriented in a generally horizontal direction wherein the longest dimension of the air reservoir 102 is arranged generally horizontal. A top edge 118 of the air reservoir 102 includes a plane generally positioned at the highest portion of the air reservoir 102. The first position 114 arranges the handle 106 and grasping region 112 generally above the top edge 118 of the air reservoir 102 and the second position 116 arranges the handle 106 and grasping region 112 generally below the top edge 118 of the air reservoir 102. By orienting the handle 106 generally below the top edge 118 of the air reservoir 102, the handle assembly 104 provides an improved lifting surface for being grasped by a user when lifting the air compressor assembly 100. In this way, a user may lift the air compressor assembly 100 in an improved manner without the struggle previously required, such as gripping the wheel assembly 108, compressor and motor assembly, trying to grasp the air reservoir 102, and the like. Further, this also results in the ability to lift the air compressor assembly 100 higher. This results in a greatly decreased likelihood of causing injury to the user and damage to the air compressor assembly 100. In the present embodiment, the handle assembly 108 is formed to be capable of moving between a first position and a second position without contacting the surface the air compressor assembly is disposed upon.

Figure 3:
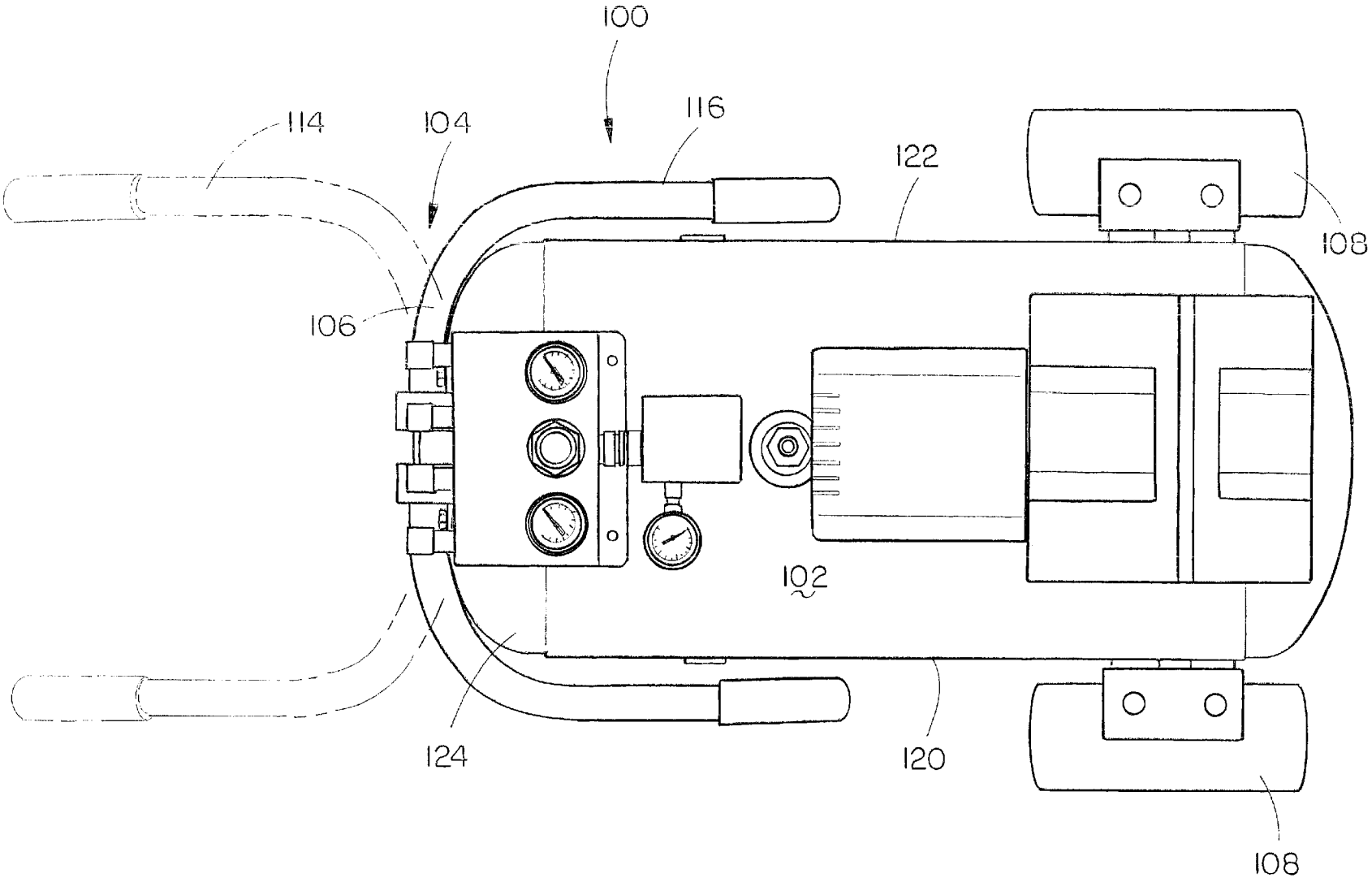
FIG. 3 is a top view of the exemplary embodiment as shown in FIG. 2 further illustrating the placement and orientation of an exemplary embodiment of the present invention.

Referring now to FIG. 3, a top view of the exemplary embodiment of the present invention as shown in FIG. 2 is illustrated. The air compressor assembly 100 includes an air reservoir 102 having a first side portion 120 and a second side portion 122. The handle assembly 104, when attaining the second position 116, generally aligns the handle 106 at least partially along at least one of the first 120 and second 122 side portions. Thus, a user grasping the handle 106 in the second position 116 need not reach as far to lift the air compressor assembly 100 as when the handle 106 is in the first position 114. Further, when the handle 106 is oriented in the second position 116, a user may have more control over the air compressor assembly 100 when lifting. When arranged in the first position 114, the handle 106 may be positioned so that it extends outward from the end portion 124 thus enabling a user to roll and control the air compressor assembly 100 when utilizing a wheel assembly 108. In this way, the handle assembly 104 may be oriented in a first position 114 with the handle 106 oriented outward from the end portion 106 to roll the air compressor assembly 100. Additionally, the handle assembly 104 may also be oriented in a second position 116 wherein the handle 106 is oriented inward from the end portion 124 to supply improved lifting capabilities.

Figure 4:
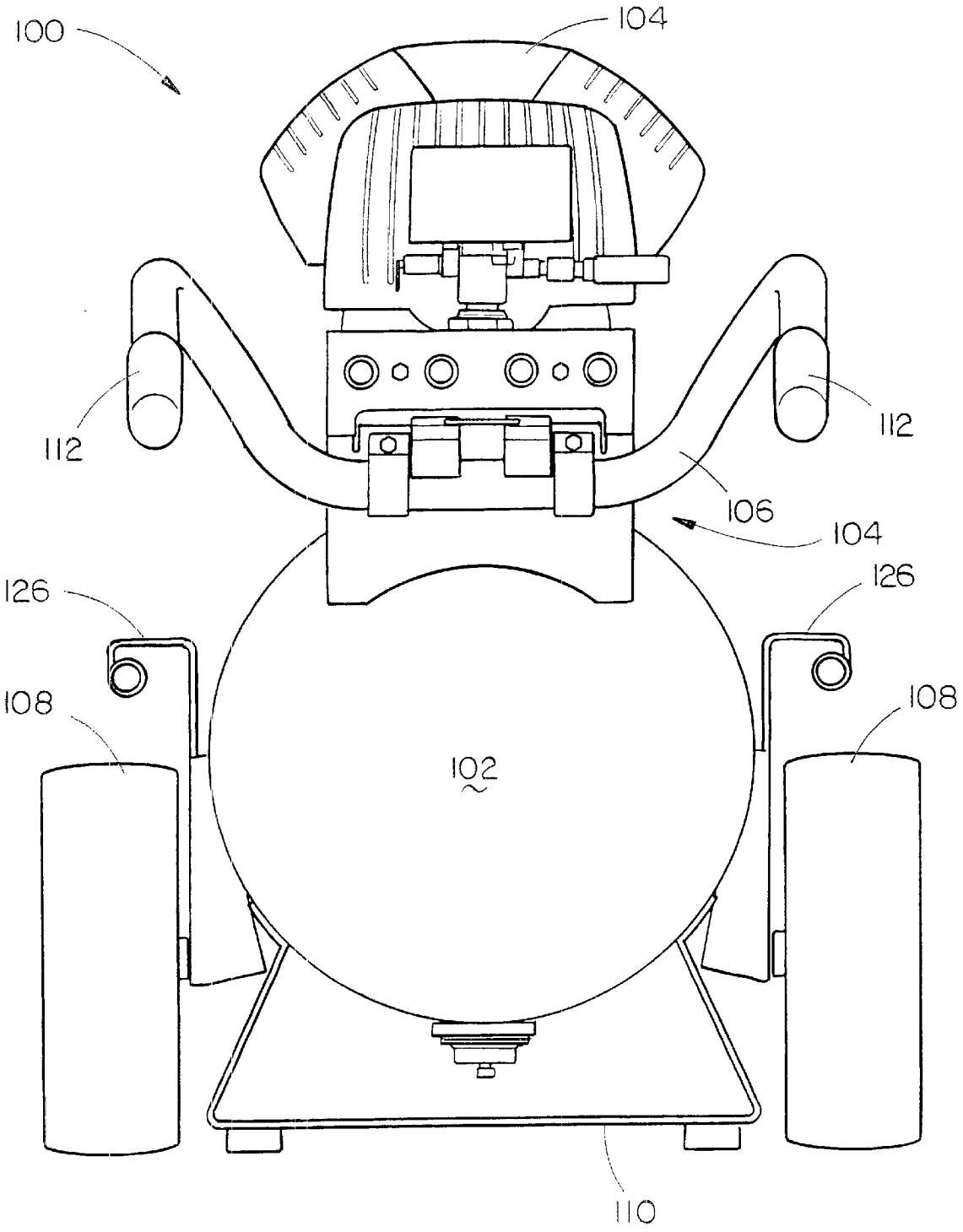
FIG. 4 is an end view of the exemplary embodiment of the present invention shown in FIG. 1.

Referring now to FIG. 4, an end view of the exemplary embodiment of the present invention as shown in FIG. 1 is depicted. An air compressor assembly 100 includes an air reservoir 102 with a compressor and motor assembly for supplying compressed air. A handle assembly 104, with a handle 106 including a grasping region 112, may be utilized to tilt the base 110 and the air compressor assembly 100 so as to utilize the wheel assembly 108. The wheel assembly 108 may include a wheel, axle, bearings, mounting devices for attaching the wheel assembly 108 to an air reservoir 102, and the like. Additionally, a second handle assembly 126 may be included to provide an additional support for lifting the air compressor assembly 100. It may be preferable to form the second handle assembly 126 as an integral part of the wheel assembly 108 so as to minimize manufacturing and production costs.

Figure 5:
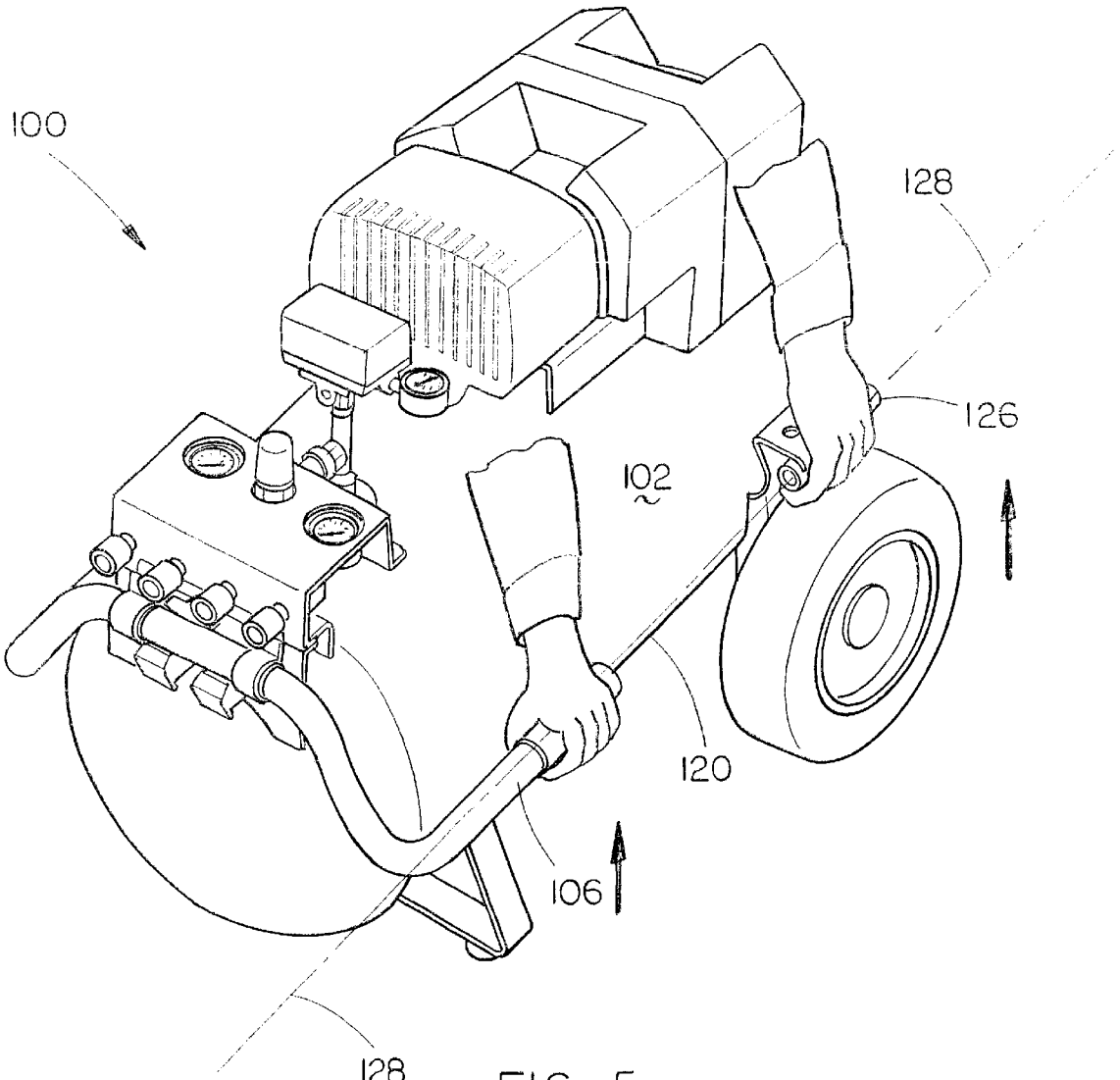
FIG. 5 is an illustration of the exemplary embodiment of FIG. 1 wherein the placement and orientation of exemplary handle assemblies is shown.

By providing a second handle assembly 126, an air compressor assembly 100 may be supported and lifted in an improved manner. For example, as shown in FIG. 5, a user may be positioned along the side 120 of the air reservoir 102 to grasp both the first handle 106 oriented in a second position 116, as described in FIG. 2, and a second handle assembly 126. In this way, the air compressor assembly 100 is supported from both the front and rearward portions, enabling the assembly 100 to be lifted in an improved manner. It may also be preferable to align the first 106 and second 126 handles along a same general line 128 of the air reservoir 102 to further enable balanced lifting. For instance, by locating the handles 106 and 126 at the same general height along the air reservoir 102, a user may lift the air compressor assembly 100 in a natural manner, without skewing or other uneven lifting motions that may be required if the handles 106 and 126 were not generally even. Thus, the potential for injury to the user and damage to the air compressor assembly 100 may be greatly diminished.

Figure 6A:
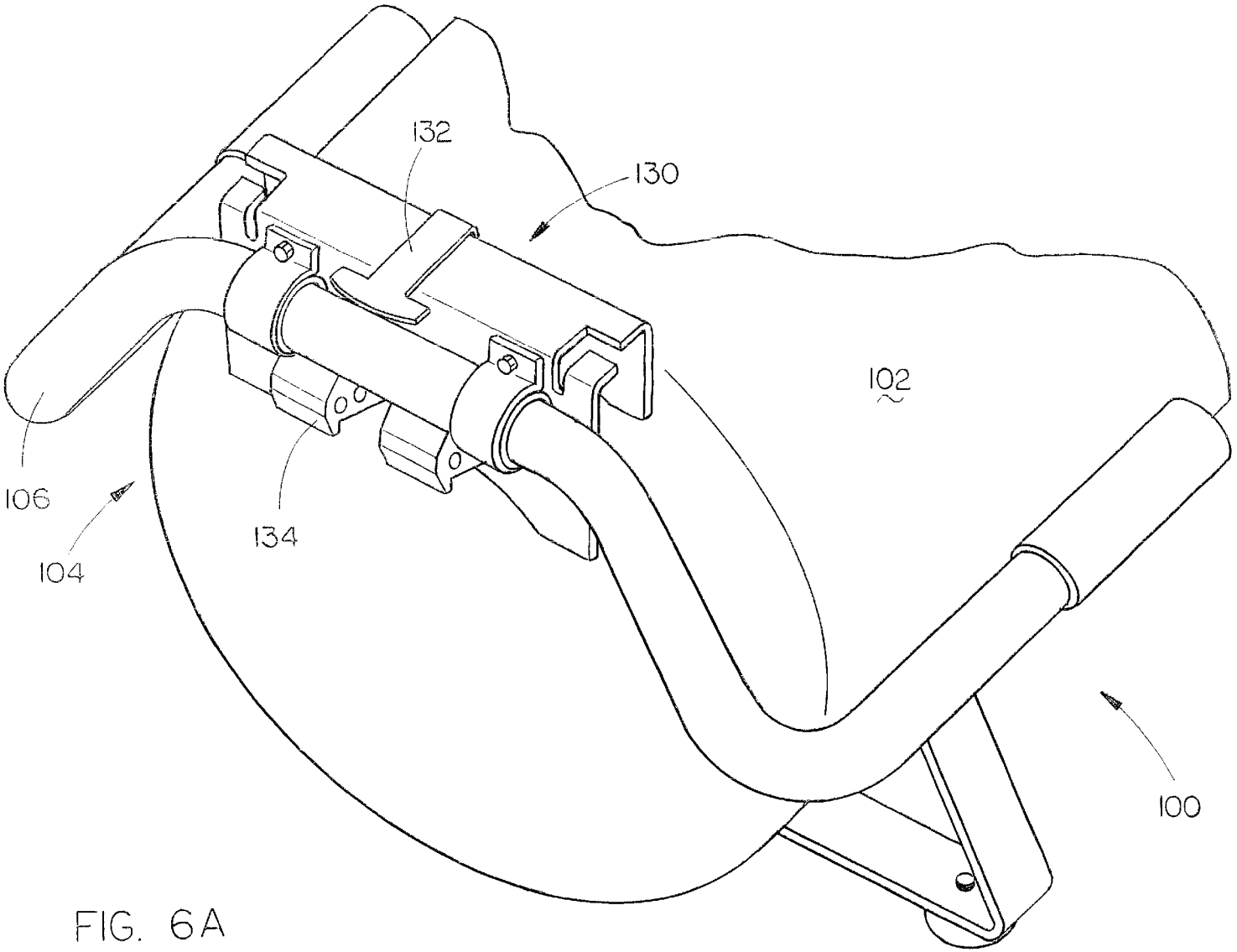
FIGS. 6A and 6B are isometric drawings of the exemplary embodiment of the present invention as shown in FIG. 1 further depicting a securing mechanism.
Figure 6B:
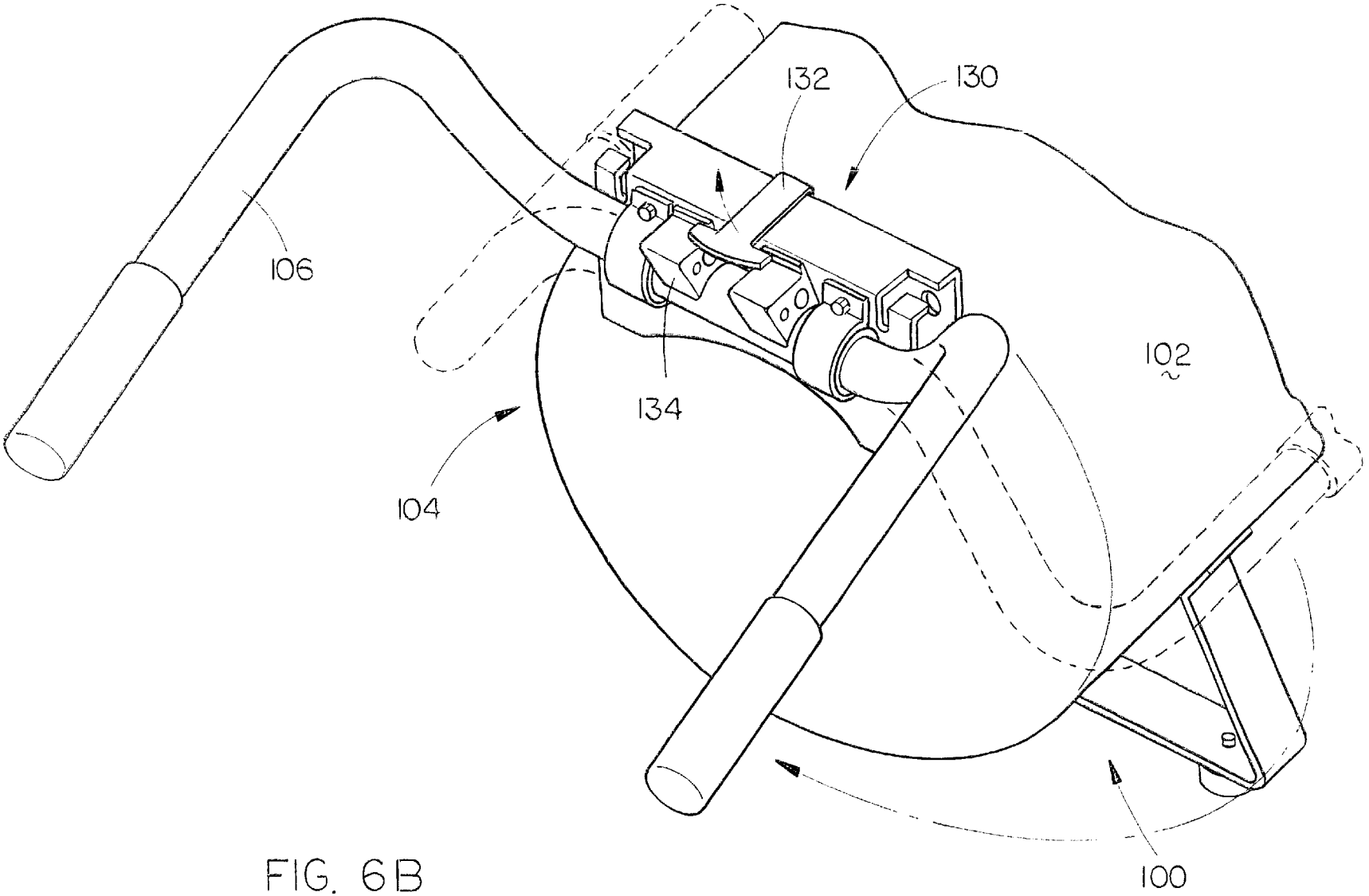

Referring now to FIGS. 6A and 6B, an exemplary embodiment of the present invention is shown wherein a securing mechanism is provided for securing the handle assembly. The air compressor assembly 100 may include a securing mechanism 130 for fastening the handle assembly 104 to limit unwanted movement, thereby increasing user control. For example, the securing mechanism 130 may include a latch 132 and bracket 134 for securing the handle assembly 104 in at least one position. The bracket 134 may be attached to the handle 106 so that when the handle assembly 104 is in a desired position the handle 106 is secured with respect to the air reservoir 102, an example of which is shown in FIG. 6B. As the handle is rotated, the bracket 134 flexes the latch 132 upward until the latch 132 engages the bracket 134, thereby securing the handle 106 to the air reservoir 102 in a position for transporting the air compressor assembly 100 utilizing the wheel assembly 108 (FIG. 1). Thus, the handle may be secured and unsecured by a user in an efficient manner.

Figure 7:
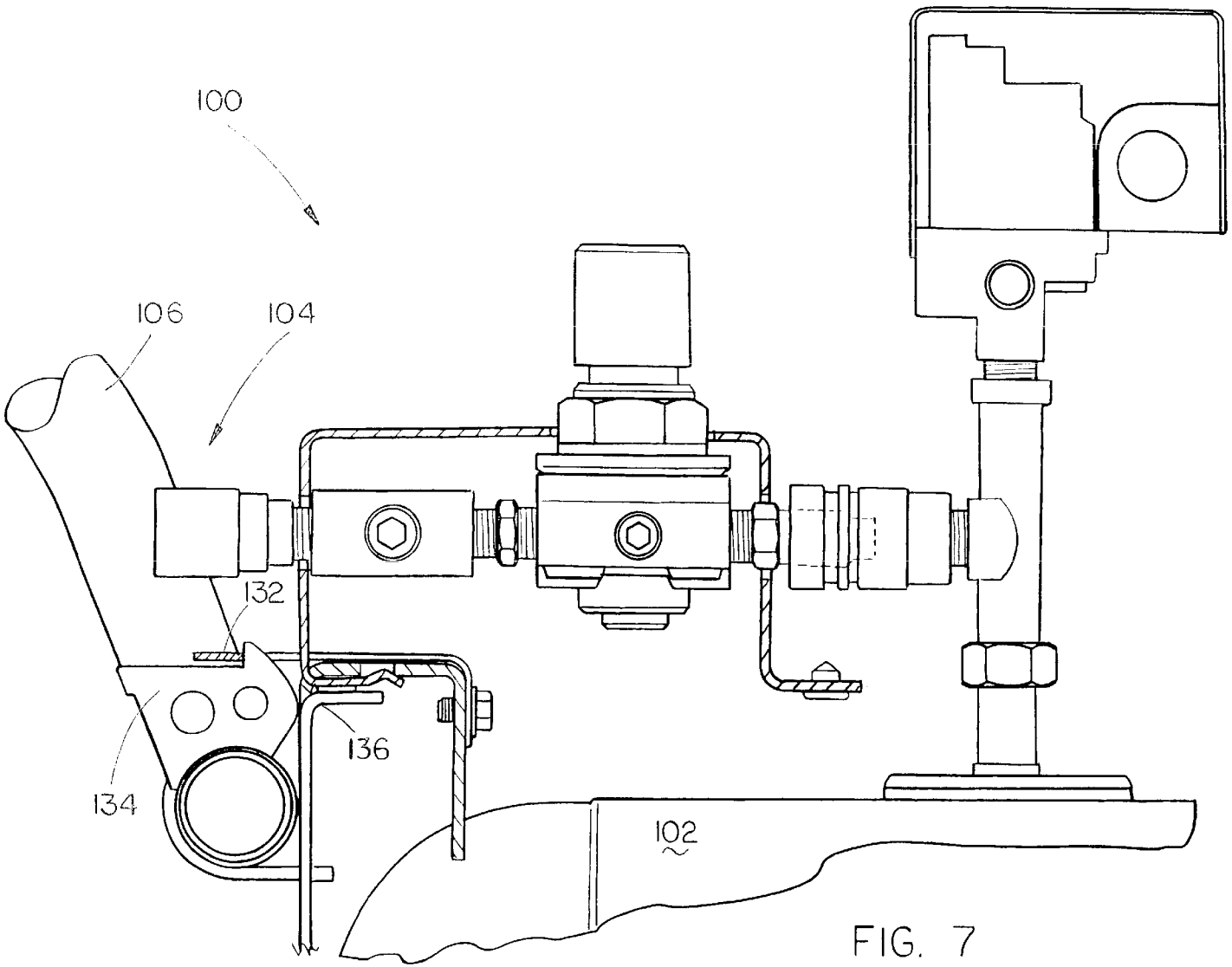
FIG. 7 is a side view of the exemplary embodiment as shown in FIG. 6 wherein a securing mechanism with a handle assembly in a raised position is shown.

As shown in FIG. 7, the bracket 134 may also be formed so as to rest against a handle assembly mounting bracket 136 so as to limit movement of the handle 106 when in the secured position. In this way, the handle assembly 104 (FIG. 2) is secured in the first position 114 (FIG. 2) so as to limit unwanted movement of the handle when the air compressor assembly 100 is positioned to utilize the wheel assembly 108 (FIG. 2).

Figure 8:
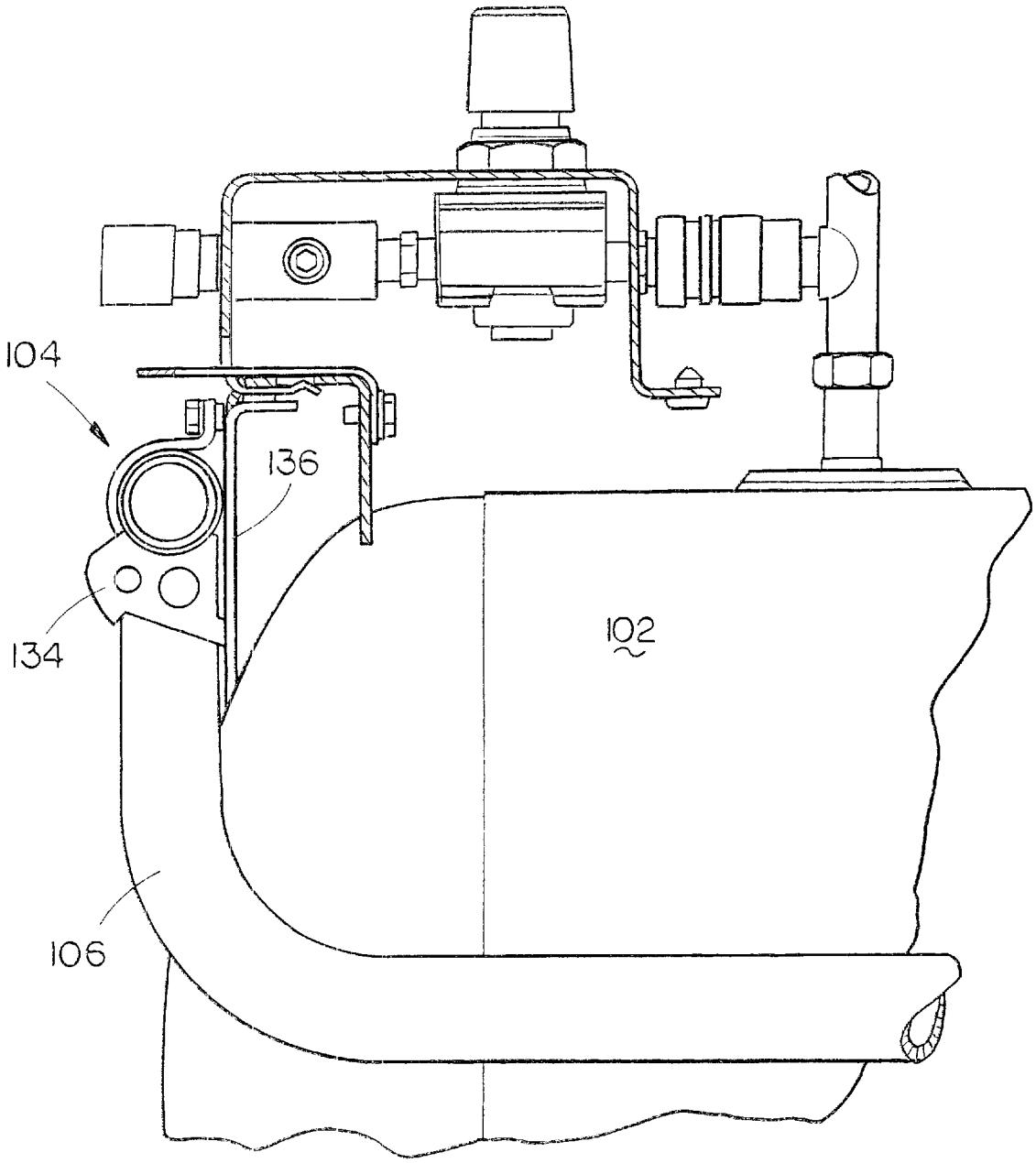
FIG. 8 is a side view of the exemplary embodiment as shown in FIG. 6 wherein a securing mechanism with a handle assembly in a lowered position is shown.

Additionally, the securing mechanism 130 may be formed to limit unwanted movement in a second position, an example of which is shown in FIG. 8. The bracket 134 may be formed to limit movement in a second position 116 (FIG. 2). For example, the bracket 134 may engage a handle assembly mounting bracket 136 to limit the movement of the handle 106 when the handle assembly 104 is in a second position 116. It may be preferable to limit the movement of the handle assembly 104 so that the handle 106 is aligned 128 (FIG. 5) with a second handle assembly 126 (FIG. 5). Thus, a user may have increased control thereby enabling improved lifting of an air compressor assembly 100. It should be apparent that a handle assembly may be secured utilizing a variety of devices to fasten the handle and may also be secured in a variety of positions without departing from the spirit and scope of the present invention, the previous discussion involving merely exemplary embodiments thereof.

Referring generally now to FIGS. 9 through 14, additional embodiments of the present invention are shown. Handle assemblies may assume a first position and a second position utilizing a variety of techniques without departing from the spirit and scope of the present invention. Additionally, the present invention contemplates a variety of handle shapes and orientations without departing from the spirit and scope of the present invention.

Figure 9:
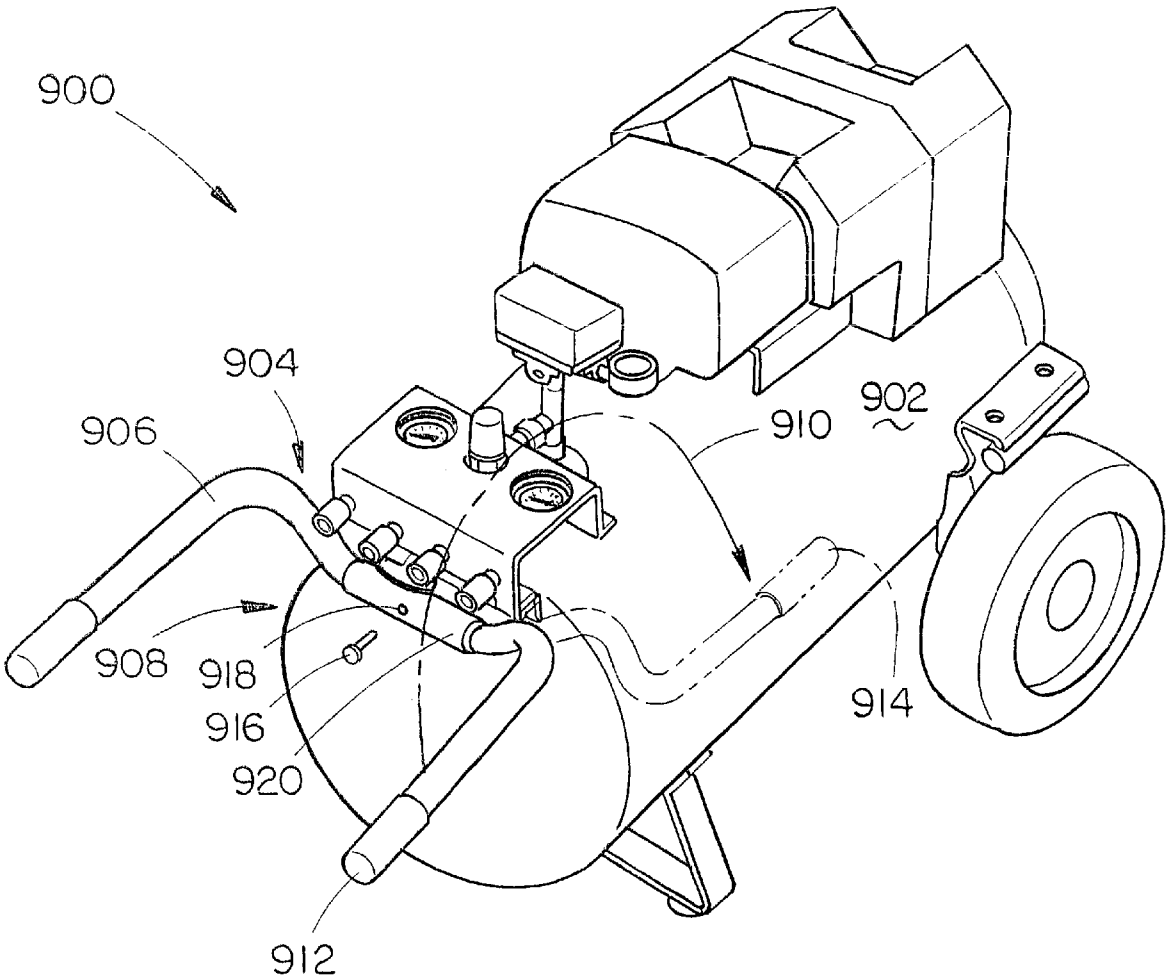
FIG. 9 is an illustration of an additional exemplary embodiment of the present invention wherein a handle assembly rotates above an air reservoir.

Referring now to FIG. 9, an additional exemplary embodiment of the present invention is shown wherein a handle assembly, including a handle, rotates above an air reservoir. An air compressor assembly 900 includes a handle assembly 904 capable of rotating a handle 906 above the top edge of the air reservoir 902. A securing mechanism 908 is provided for locking the handle 906 along a plurality of positions along the arc 910 of the handle 906 rotation wherein the handle assembly 906 moves between a first position 912 and a second position 914. The securing mechanism 908 utilizes a pin assembly in which a pin 916 is inserted through a hole 918 in a handle assembly mounting bracket 920 into a receiving portion of the handle 906. Thus, the handle 906 may be secured in a plurality of positions as desired by a user.

Figure 10:
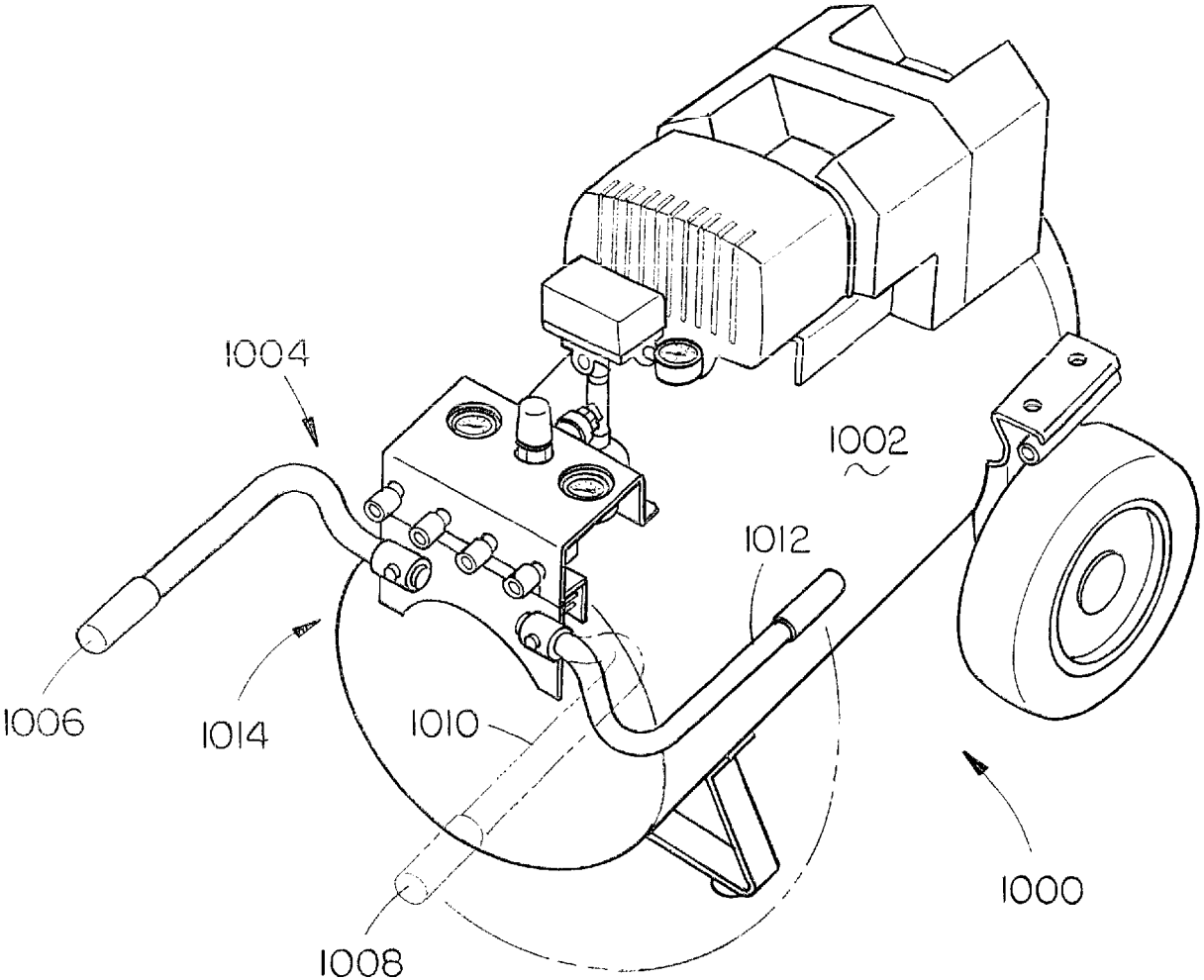
FIG. 10 is an illustration of an additional exemplary embodiment of the present invention wherein an air compressor assembly includes a handle assembly including multiple handles.

Referring now to FIG. 10, an additional exemplary embodiment of the present invention is shown wherein an air compressor assembly includes a handle assembly including multiple handles. An air compressor assembly 1000 includes an air reservoir 1002 with a handle assembly 1004 disposed thereon, the handle assembly 1004 having a first handle 1006 and a second handle 1008. The first handle 1006 and the second handle 1008 are each capable of separate movement from a first position 1010 to a second position 1012. A securing mechanism 1014 is provided to fasten the handles 1006 and 1008 at a plurality of positions to which the handles 1006 and 1008 are moved. Thus, the handle assembly 1004 and particularly the handles 1006 and 1008 are capable of being placed in a variety of separate and different positions from each other as desired by a user, thereby increasing the flexibility of the air compressor assembly 1000.

Figure 11:
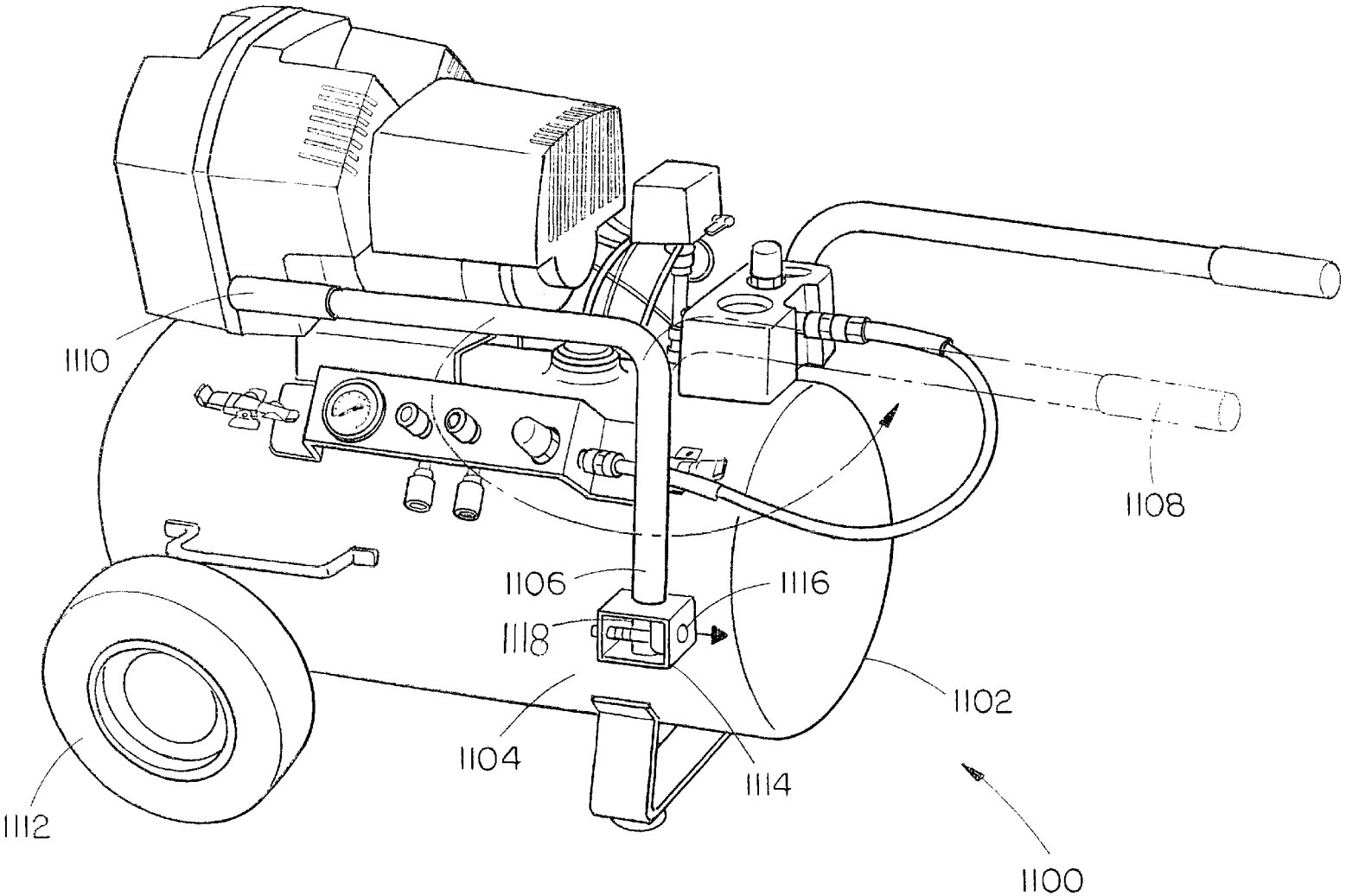
FIG. 11 is an illustration of an additional exemplary embodiment of the present invention wherein an air compressor assembly includes a handle assembly capable of pivotal movement.

Referring now to FIG. 11, an additional exemplary embodiment of the present invention is shown wherein an air compressor assembly includes a handle assembly capable of pivotal movement. An air compressor assembly 1100 may include an air reservoir 1102 with a handle assembly 1104 disposed thereon. A handle 1106 of the handle assembly 1104 is capable of pivoting between a first position 1108 and a second position 1110. The first position 1108 is suitable transporting the air compressor assembly utilizing the wheel assembly 1112 and the second position 1110 is suitable for providing a lifting surface wherein a user may grasp the handle 1106 of the handle assembly 1104. A securing mechanism 1114 may also be provided for securing the handle 1106 in a desired position. The securing mechanism 1114 may include a pin 1116 to engage a knuckle portion 1118 of the handle 1106 thereby securing the handle 1106 in position.

Figure 12:
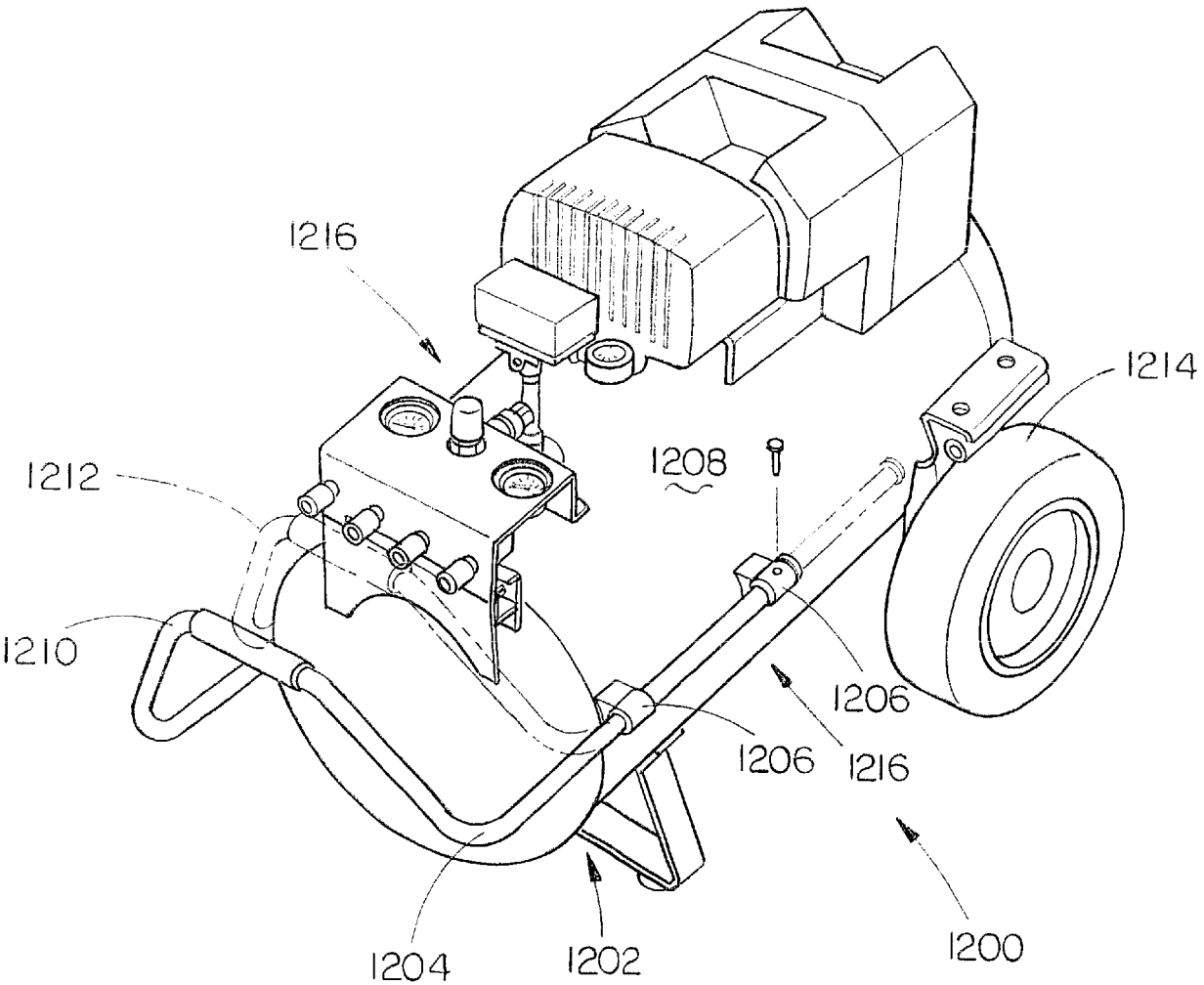
FIG. 12 is an illustration of an additional exemplary embodiment of the present invention wherein an air compressor assembly includes a handle assembly capable of telescopic movement.

Referring now to FIG. 12, an additional exemplary embodiment is shown wherein an air compressor assembly includes a handle assembly capable of telescopic movement. An air compressor assembly 1200 may include a handle assembly 1202 including a handle 1204 mounted with the use of brackets 1206 disposed on an air reservoir 1208. The brackets 1206 enable the handle 1204 to telescope between a first position 1210 and a second position 1212. The first position 1210 is suitable for rolling the air compressor assembly 1200 utilizing the wheel assembly 1214. It may be preferable to form the brackets 1206 so that the handle 1204 is at a sufficient distance from the air reservoir 1208 to enable the handle 1204 to be gripped by a user at the sides 1216 of the air reservoir 1208. Thus, the handle assembly 1202 may provide a greater gripping area when placed in the second position 1212 yet enable the air compressor assembly to be rolled when placed in the first position 1210.

Figure 13:
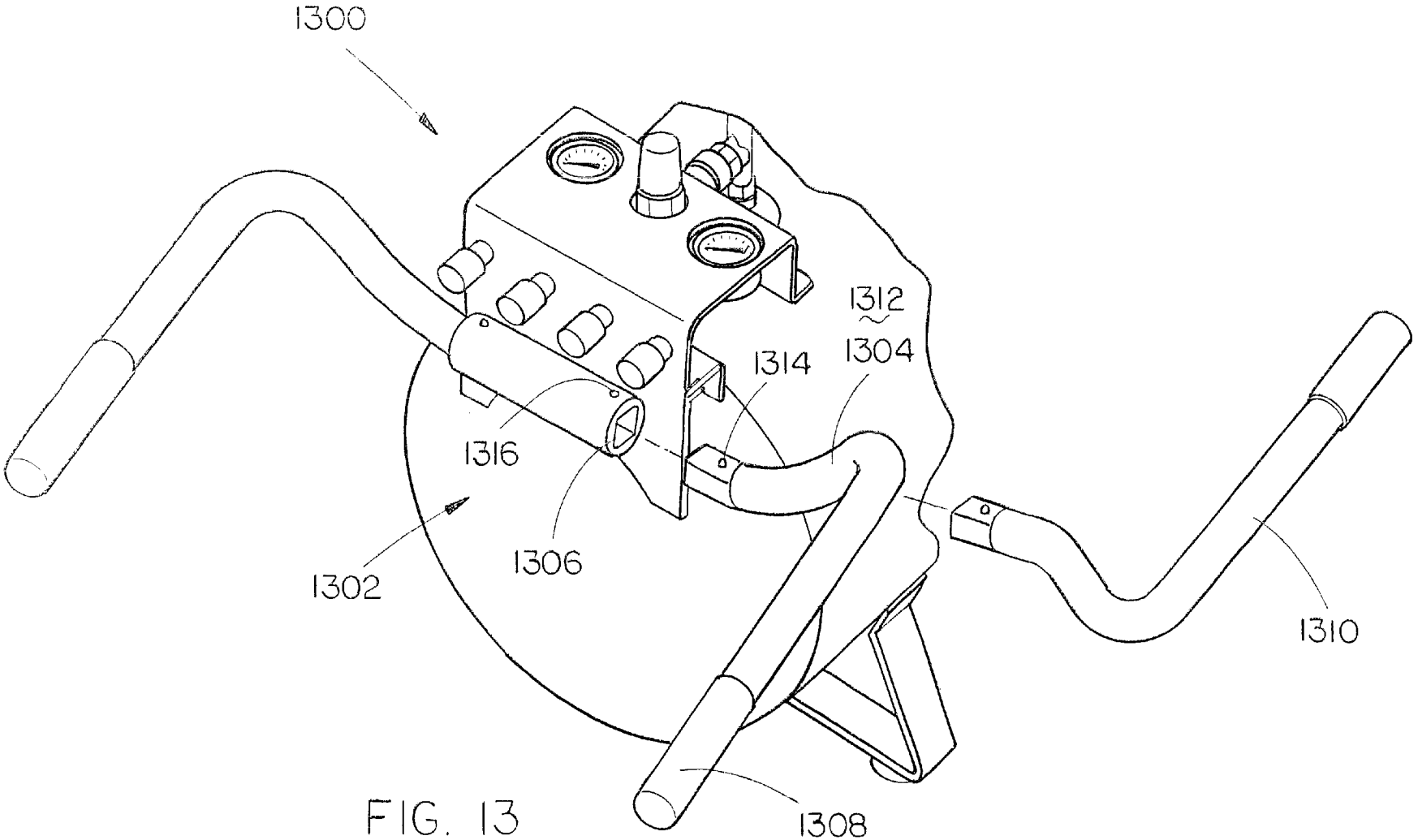
FIG. 13 is an illustration of an additional exemplary embodiment of the present invention wherein an air compressor assembly includes a handle assembly with a handle capable of being removed and placed in a plurality of positions.

Referring now to FIG. 13, an additional exemplary embodiment of the present invention is shown wherein an air compressor assembly includes a handle assembly with a handle capable of being removed and placed in a plurality of positions. An air compressor assembly 1300 includes a handle assembly 1302. The handle assembly 1302 may include a handle 1304 capable of assuming multiple positions by withdrawing the handle 1304 from a receptacle 1306 formed as a part of the handle assembly 1302. By utilizing this arrangement, the handle 1304 may be removed, repositioned and inserted into the receptacle 1306 to provide a plurality of positions. For instance, a user may wish to transport the air compressor assembly 1300 by utilizing a wheel assembly 108 (FIG. 2). To accomplish this, the user may place the handle 1304 in a first position 1308 so that the user may grasp the handle 1304 to tilt a base 110 (FIG. 2) and thereby enable the air compressor assembly 1300 to be rolled. In another instance, the user may wish to lift the air compressor assembly 1300 to a higher surface. Thus, the user may reposition the handle 1304 in a second position 1310 so that it is disposed adjacent to a side of an air reservoir 1312. It should be apparent that the handle 1304 and handle assembly 1302 may be placed in a variety of positions and orientations without departing from the spirit and scope of the present invention.

It may also be preferable to provide a securing mechanism to fasten the handle 1304 to the receptacle 1306. For example, the securing mechanism may include a retractable pin assembly 1314 formed on the handle 1304 and an receiving portion 1316 formed on the receptacle 1306 to receive the pin assembly 1314 and thereby secure the handle 1304 in the receptacle 1306. Further, the handle 1304 and the receptacle 1306 may be formed so as to limit unwanted movement of the handle assembly 1302. It is contemplated that a person of ordinary skill in the art may change the form of the securing mechanism, including the orientation and shape of the handle and receptacle, in a variety of ways without departing from the present invention.

Figure 14:
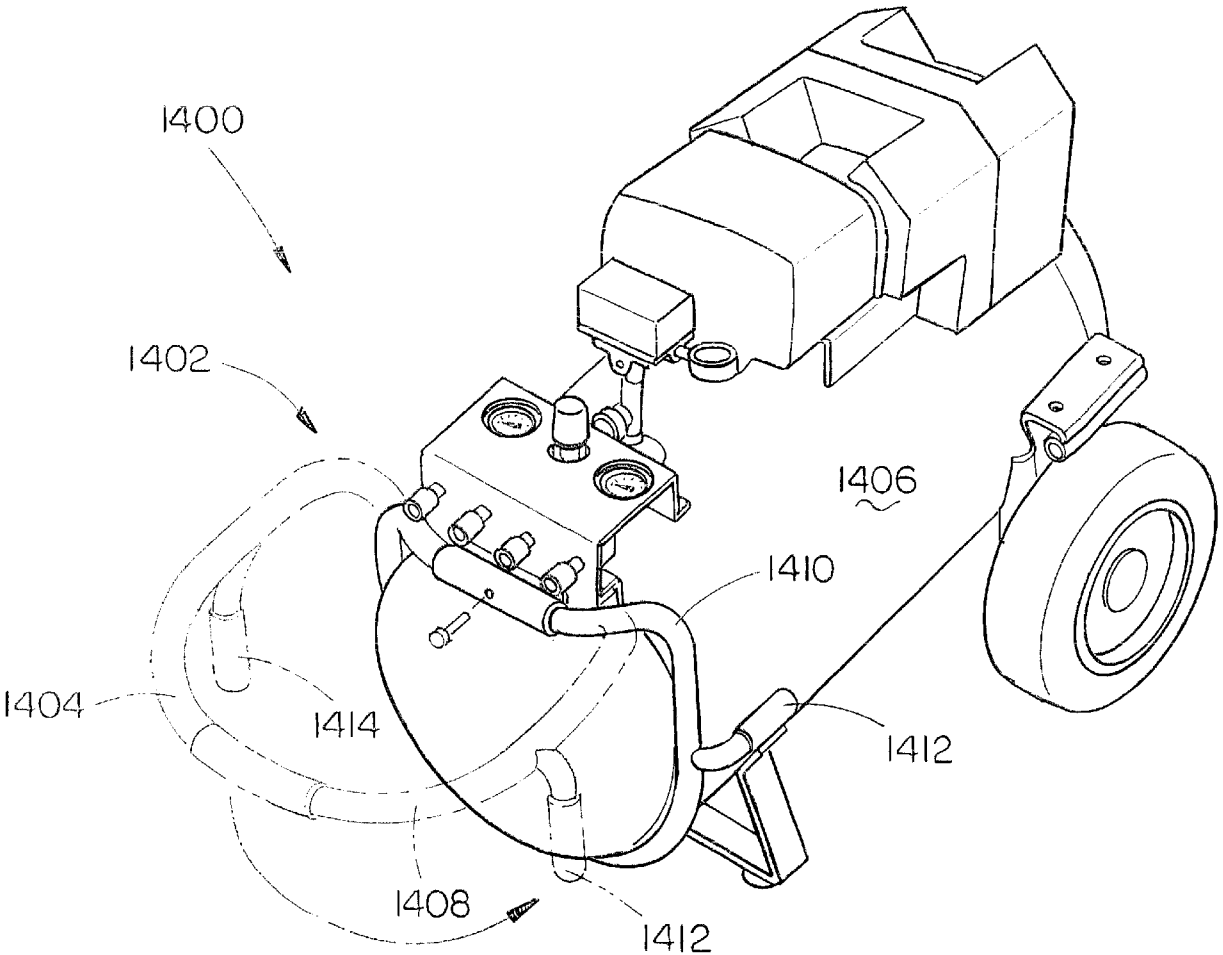
FIG. 14 is an illustration of an additional exemplary embodiment of the present invention wherein a handle assembly is formed so as to provide protection to an air compressor assembly.

Referring now to FIG. 14, an additional exemplary embodiment of the present invention is shown wherein a handle assembly is formed so as to provide protection to an air compressor assembly. An air compressor assembly 1400 includes a handle assembly 1402 with a handle 1404 formed to be capable of at least partially surrounding an air reservoir 1406. The handle 1404 of the handle assembly 1402 is capable of assuming a first position 1408 for transporting the air compressor assembly 1400 and a second position 1410 for lifting and protecting the air compressor assembly 1400. The second position 1410 orients the handle assembly 1402 so as to protect the air reservoir 1406 from bumps from foreign objects, jarring during transport, and the like. A first grasping portion 1412 and a second grasping portion 1414 may be provided for lifting the air compressor assembly 1400 when the handle assembly 1404 is in the second position 1410.

It is believed that the air compressor assembly including a handle capable of attaining a plurality of positions of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An air compressor assembly, comprising:

an air reservoir suitable for storing compressed air under pressure, the reservoir having a first side portion and a second side portion; and a handle assembly including a handle, the handle assembly disposed on the air reservoir, the handle assembly capable of attaining a first position and a second position, wherein the second position generally aligns the handle assembly at least partially along at least one of the first and second side portions.

2. The air compressor assembly as described in claim 1, wherein the air reservoir includes an end portion, the first position includes the handle assembly positioned so that the handle extends outward from the end portion.

3. The air compressor assembly as described in claim 2, wherein the first position is suitable for transporting the air compressor assembly by utilizing a wheel assembly and the second position is suitable for lifting the air compressor assembly.

4. The air compressor assembly as described in claim 1, wherein second position aligns the handle assembly so that the handle does not extend above a top edge of the air reservoir.

5. The air compressor assembly as described in claim 1, further comprising a second handle assembly.

6. The air compressor assembly as described in claim 5, wherein the first handle assembly and the second handle assembly are disposed on at least one of the first side and second side of the air reservoir so as to be suitable for lifting the air compressor assembly.

7. The air compressor assembly as described in claim 6, wherein the second lifting handle assembly is disposed proximally to a wheel assembly.

8. The air compressor assembly as described in claim 5, wherein the first handle assembly and the second handle assembly are oriented so as to be generally aligned along a horizontal line extending along the air reservoir.

9. The air compressor assembly as described in claim 1, wherein the air reservoir includes at least one of an air storage tank formed in a generally cylindrical shape and a first air storage tank and a second air storage tank formed in generally cylindrical shapes.

10. The air compressor assembly as described in claim 1, further comprising a securing mechanism suitable for securing the handle assembly in at least one of the first position and the second position.

11. An air compressor assembly, comprising:

an air reservoir suitable for storing compressed air, the reservoir having a top edge; and a handle assembly including a handle disposed on the air reservoir, the handle assembly capable of attaining a first position and a second position, wherein the first position arranges the handle generally above the top edge of the air reservoir and the second position arranges the handle generally below the top edge of the air reservoir.

12. The air compressor assembly as described in claim 11, wherein the air reservoir includes an end portion, the first position includes the handle assembly positioned so that the handle extends outward from the end portion.

13. The air compressor assembly as described in claim 11, wherein the first position is suitable for transporting the air compressor assembly by utilizing a wheel assembly and the second position is suitable for lifting the air compressor assembly.

14. The air compressor assembly as described in claim 11, further comprising a second handle assembly.

15. The air compressor assembly as described in claim 14, wherein the first handle assembly and the second handle assembly are disposed on at least one of the first side and second side of the air reservoir so as to be suitable for lifting the air compressor assembly.

16. The air compressor assembly as described in claim 15, wherein the second lifting handle assembly is disposed proximally to a wheel assembly.

17. The air compressor assembly as described in claim 14, wherein the first handle assembly and the second handle assembly are oriented so as to be generally aligned along a horizontal line extending along the air reservoir.

18. The air compressor assembly as described in claim 11, wherein the air reservoir includes at least one of an air storage tank formed in a generally cylindrical shape and a first air storage tank and a second air storage tank formed in generally cylindrical shapes.

19. The air compressor assembly as described in claim 11, further comprising a securing mechanism suitable for securing the handle assembly in at least one of the first position and the second position.

20. An air compressor assembly, comprising:

an air reservoir suitable for storing compressed air having an end portion; and a handle assembly disposed on the air reservoir, the handle assembly capable of attaining a first position and a second position, wherein the first position arranges the handle assembly generally outward from the end portion and the second position arranges the handle assembly generally inward from the end portion.

21. The air compressor assembly as described in claim 20, wherein the first position is suitable for transporting the air compressor assembly by utilizing a wheel assembly and the second position is suitable for lifting the air compressor assembly.

22. The air compressor assembly as described in claim 20, wherein second position aligns the handle assembly so that the handle assembly does not extend above a top edge of the air reservoir.

23. The air compressor assembly as described in claim 20, further comprising a second handle assembly.

24. The air compressor assembly as described in claim 23, wherein the first handle assembly and the second handle assembly are disposed on at least one of the first side and second side of the air reservoir so as to be suitable for lifting the air compressor assembly.

25. The air compressor assembly as described in claim 24, wherein the second lifting handle assembly is disposed proximally to a wheel assembly.

26. The air compressor assembly as described in claim 23, wherein the first handle assembly and the second handle assembly are oriented so as to be generally aligned along a horizontal line extending along the air reservoir.

27. The air compressor assembly as described in claim 20, wherein the air reservoir includes at least one of an air storage tank formed in a generally cylindrical shape and a first air storage tank and a second air storage tank formed in generally cylindrical shapes.

28. The air compressor assembly as described in claim 20, further comprising a securing mechanism suitable for securing the handle assembly in at least one of the first position and the second position.

29. An air compressor assembly, comprising:

an air reservoir suitable for storing compressed air;

a wheel assembly disposed on the air reservoir, the wheel assembly suitable for transporting the air reservoir; and a handle assembly including a handle disposed on the air reservoir, the handle assembly capable of attaining a first position and a second position, wherein the first position arranges the handle so as to be suitable for transporting the air compressor assembly utilizing the wheel assembly and the second position arranges the handle so as to be suitable for lifting the air compressor assembly.

30. The air compressor assembly as described in claim 29, further comprising a second handle assembly.

31. The air compressor assembly as described in claim 30, wherein the first handle assembly and the second handle assembly are disposed on at least one of the first side and second side of the air reservoir so as to be suitable for lifting the air compressor assembly.

32. The air compressor assembly as described in claim 30, wherein the first handle assembly and the second handle assembly are oriented so as to be generally aligned along a horizontal line extending along the air reservoir.

* * * * *